US005590880A

United States Patent [19]

Flam

[11] Patent Number: 5,590,880

[45] Date of Patent: Jan. 7, 1997

[54] PLAYING CARD HOLDER

[76] Inventor: Frederick H. Flam, 31203 Via Margarita, Bonsall, Calif. 92003

[21] Appl. No.: 551,922

[22] Filed: Oct. 23, 1995

[51] Int. Cl.[6] ..... A63F 1/10

[52] U.S. Cl. ..... 273/150

[58] Field of Search ..... 273/150, 148 A; D21/54, 55, 57, 58

[56] References Cited

U.S. PATENT DOCUMENTS 2,115,276 4/1938 Morse ..... 273/148 A 2,717,156 9/1955 Nelson ..... 273/148 A X

*Primary Examiner*—William H. Grieb

[57] ABSTRACT

A card holder in the form of a shell or shield has juxtaposed layers forming a slot or pocket into which a number of playing cards are inserted. The pocket is made of relatively stiff plastic that resiliently resists flexure whereby a yielding friction grip is imposed upon the set of playing cards. The shell or shield has sides and an overhanging top together effectively shielding the cards from all but frontal view. In the preferred form of the present invention, a bar is placed behind the tops of the cards to flex them away from the back of the holder so that the tops of the cards are easily accessible for grasp.

5 Claims, 2 Drawing Sheets

PLAYING CARD HOLDER

FIELD OF INVENTION

This invention relates to games played with playing cards, and more particularly to apparatus for holding the playing cards.

BACKGROUND OF THE INVENTION

Apparatus for holding playing cards have long been known, primarily for the purpose of assisting those whose dexterity is impaired. One well known and commonly used device is simply a bar having a series of parallel slots having a depth of a fraction of the height of standard playing cards. The bar rests upon the card table. The playing cards are sorted, usually one by one, and inserted into the slots. This device eliminates the task of physically holding the cards.

Another known device comprises two disk like elements frictionally urged together and between which the cards are placed. The user is required to hold the device, but is relieved of the task of holding all of the cards together as a set.

During the play of a card game, such as contract bridge, an opponent may improperly derive information from the fact that a player holding presumably concealed cards detaches a low spot card, say, third from the end. The opponent who casually and discreetly observed this may infer that the player holds at least three cards in the suit played, and most likely only three. This information is technically unauthorized; players are instructed not to look at the cards of others while cards are being detached. It is far, far easier for an opponent to observe cards played from a card holder, such as the slotted bar.

Another problem in playing a card game such as contract bridge is that players often hold their cards in such a casual manner that opponents to the right and left can see the faces of some or all of the cards. Those with good vision can often take finesses in the right direction, and/or drop single-ton honors. Undisciplined players often detach a card, and then, before facing it in play, change plans, replace the card and detach another. This gives increased opportunity for unauthorized view. Some players resent being told by opponents that their cards are so poorly held and that they can be seen. Players guilty of improperly holding cards are habituated and rarely take corrective measures. Other nearly paranoid players never sort their cards, or hold them under the table, or constantly rearrange their cards, or hold them upside down, etc.

The primary object of the present invention is to provide a device designed to maintain the integrity of a card game in which players presumably conceal their cards during the course of play. Another object of the present invention is to provide a device of this character that holds the cards while effectively concealing them, all while requiring only minimum manual dexterity.

SUMMARY OF INVENTION

In order to accomplish the foregoing objectives, I provide a shell having a narrow pocket or slot for frictionally gripping a set of playing cards. The shell has top and sides effectively shielding the cards from view. The shell has means to facilitate thumb/forefinger grasp of the top of the card. In the preferred form of the present invention, a bar is placed behind the tops of the cards to flex them away from the back of the shell so that the tops of the cards are accessible for grasp.

BRIEF DESCRIPTION OF THE DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF THE PREFERRED EMBODIMENT

The following detailed description is of the best presently contemplated mode of carrying out the invention. This description is not to be taken in a limiting sense, but is made merely for purposes of illustrating the general principles of the invention, the scope of the invention being defined by the appended claims.

Structural and operational characteristics attributed to the form of the invention first described shall also be attributed to form later described, unless such characteristics are obviously inapplicable or unless specific exceptions are made.

Figure 1:
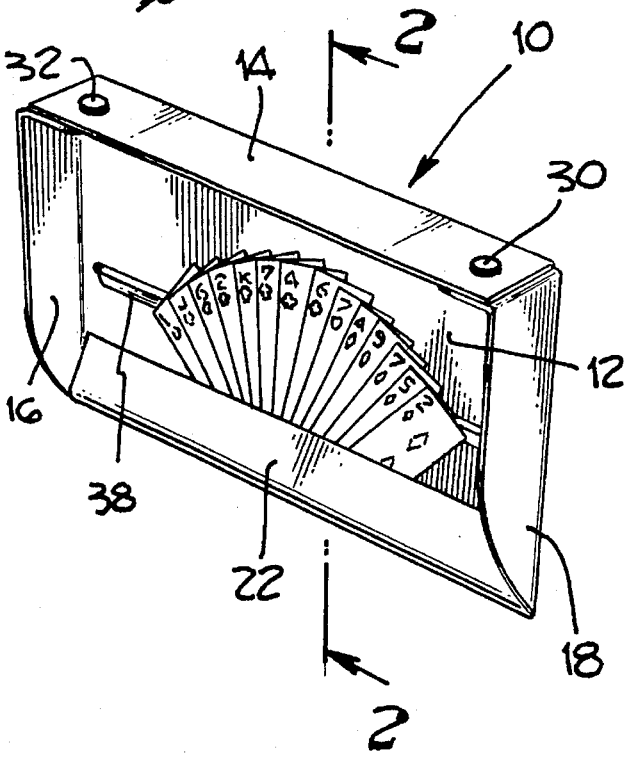
FIG. 1 is front perspective view of a playing card holder incorporating my invention, a set of thirteen "fanned" playing cards being inserted into the holder.
Figure 2:
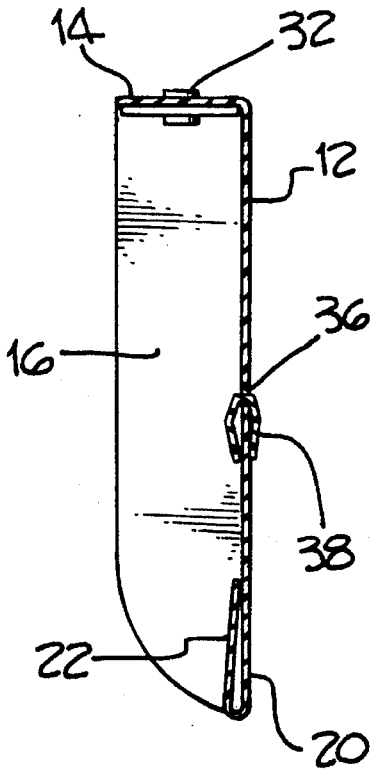
FIG. 2 is a sectional view taken along a plane corresponding to line 2—2 of FIG. 1.

The playing card holder 10 shown in FIG. 1 is a thin shell generally in the approximate form of a rectangular parallelopiped with a back 12, top 14 and sides 16, 18. The top 14 and sides 16, 18 form a space shielded from all but frontal view. Playing cards are held within this shielded space. For this purpose a narrow slot or pocket 20 (FIG. 2) is formed by closely juxtaposed layers, one of the layers being the back 12 itself, and the other layer being a leaf or flange 22 extending along the bottom of the shell.

Figure 3:
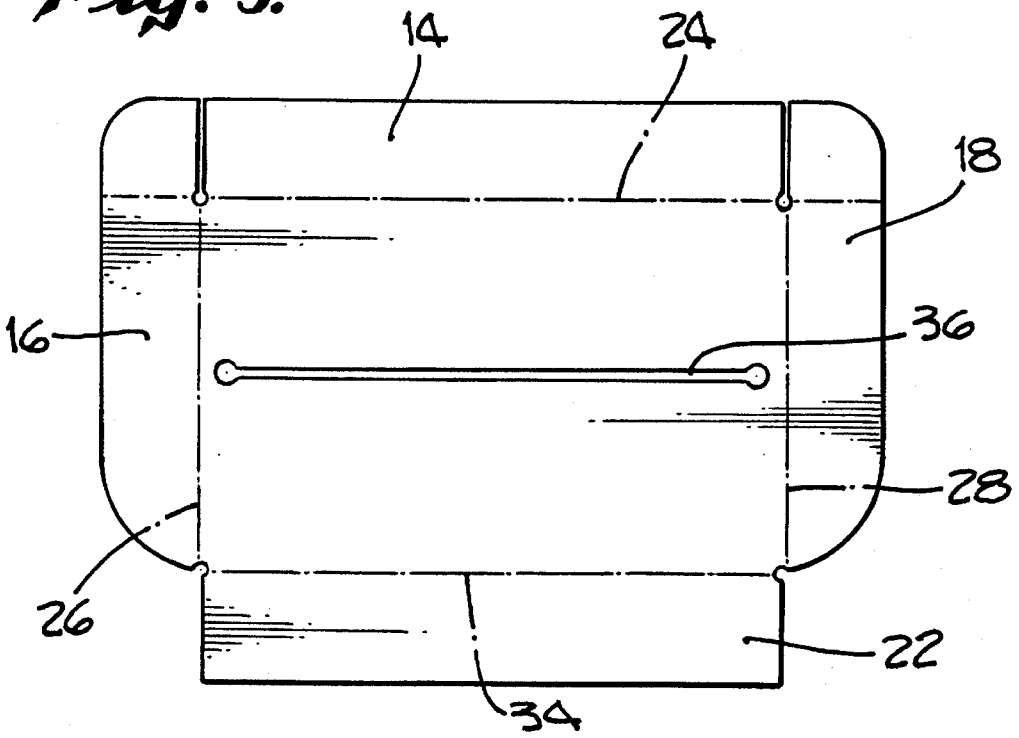
FIG. 3 is a plan view of a a die cut plastic sheet before it is folded into the configuration of the shield shown in FIG. 1.

As shown in FIG. 3, the holder is made from a die cut piece of flexible plastic, preferably commercial grade polystyrene having a thickness of about 0.040". The plastic is folded by heat scoring along lines 24, 26 and 28 so that the top and sides 14, 16 and 18 are formed by 90™ bends. Rivets 30 and 32 or other fastening means, such as integral locking tabs, secure the overlapped corners of the sides and top to hold the parts in parallelopiped or shell configuration.

After the sides and top are formed, the flange or leaf 22 is folded 180™ by heat scoring along the line 34 to lie in close superposed relationship to the bottom part of the holder back 12. The folding process results in the flange or leaf being hinged along its lower edge to the bottom of the shell back 12. The hinge exhibits characteristics of resilience such that the flange or leaf 22 resiliently resists movement away from the shell back 12. Accordingly, a fanned set of playing cards are firmly and frictionally, but yieldingly held in the pocket.

The back 12 of the holder has a longitudinal slit 36 positioned to lie somewhat below the tops of the playing cards. This allows the hand of the player to flex the top of the back away from the cards whereby the top corner of the card to be played is accessible for grasp and removal.

Figure 4:
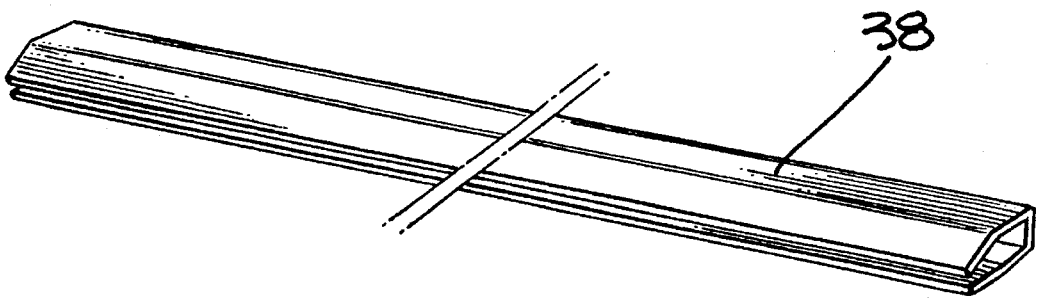
FIG. 4 is a perspective view of the plastic binding spine forming a part of the shield of FIG. 1.

Preferably, a plastic spine 38 (See also FIG. 4) is inserted into the slit to form a bar whereby the tops of the playing cards are flexed forwardly and away from the back of the holder. Accordingly, the tops of the cards are normally spaced from the back of the holder, minimizing or obviating entirely, flexure of the holder back.

Figure 5:
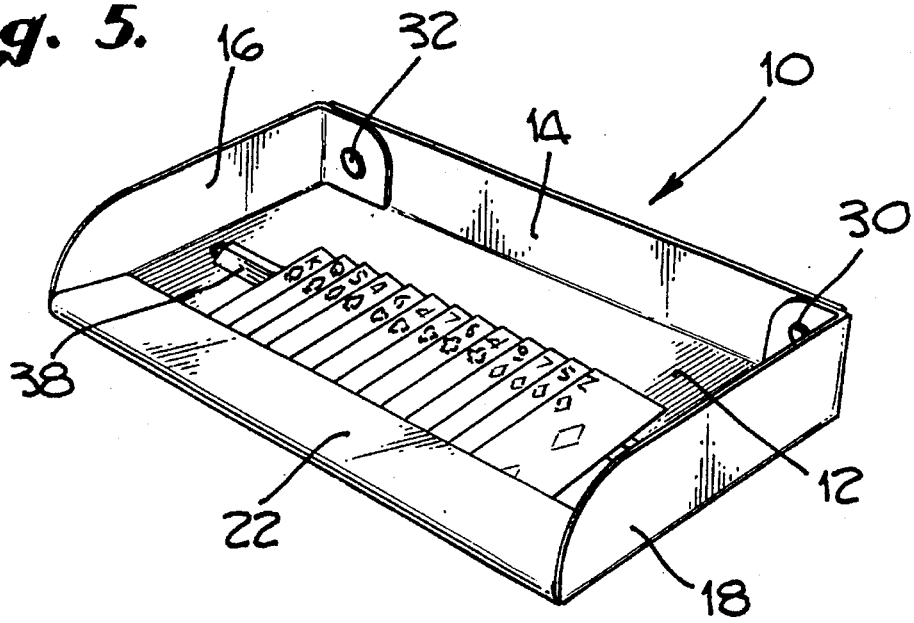
FIG. 5 is a pictorial view of the holder, but showing a set of playing cards placed in an alternate manner.

FIG. 5 illustrates an alternate mode for use of the holder. In this case, the cards are not fanned, but placed in juxtaposed relationship into the slot. The cards may be sorted as they are placed one by one into the slot 20. In FIG. 1, the cards are first sorted and fanned and then placed as a set into the slot 20.

Figure 6:
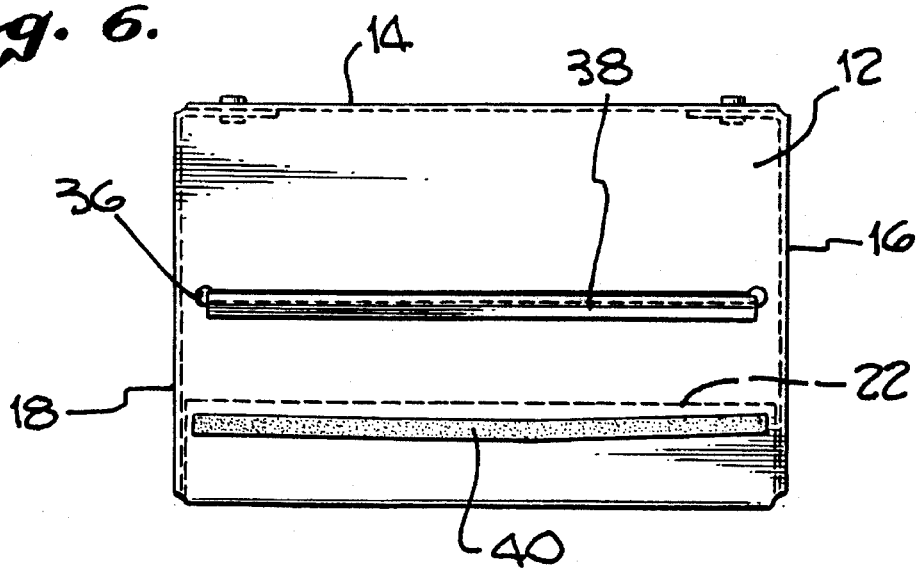
FIG. 6 is a rear view of a modified form of the playing card holder.

The slit allows the fingers of one hand of the user to be inserted from the back whereby the holder itself may be held. Optionally, a strap 40 may be attached to the back of the holder, as shown in FIG. 6.

Instead of constructing the holder from die cut plastic, it may be made of molded plastic, in which case the top of the back of the holder may be offset rearwardly at the location of the longitudinal slit.

Intending to claim all novel, useful and unobvious features and combinations of features shown and/or described, I claim:

1. A playing card holder having a back, sides and a top, said sides and top substantially circumscribing and overhanging said holder back to form a shell; means forming a pocket within said shell and sized removably to receive a series of playing cards with their top edges exposed for view by the player of the cards; said top and sides shielding said playing cards from all but frontal view.

2. The playing card holder as set forth in claim 1 together with a bar attached to the shell and located behind the upper portions and the playing cards to flex them away from the back of the shell whereby the individual playing cards are accessible for thumb/forefinger grasp.

3. The playing card holder as set forth in claim 1 in which said shell is made of die cut sheet plastic material, with the sides and tops being formed by folding the plastic to form the shell, and in which a leaf or flange at the bottom of the shell is folded upwardly to form the said pocket for reception of playing cards.

4. The playing card holder as set forth in claim 1 in which said shell is made of flexible material, said shell having a longitudinal slot dividing the back of said shell into an upper and a lower portion, the upper portion being capable of rearward flexure by digital pressure to expose the top of the cards for thumb/forefinger grasp.

5. The playing card holder as set forth in claim 4 in which a plastic spine is inserted into said longitudinal slot to form a bar normally flexing the top portions of playing cards away from the back of said shell.

* * * * *